US005292993A

United States Patent [19]

Hälsig

[11] Patent Number: 5,292,993

[45] Date of Patent: Mar. 8, 1994

[54] PROCESS FOR REMOVING IMPURITIES FROM PETROLEUM PRODUCTS

[75] Inventor: Claus-Peter T. Hälsig, London, England

[73] Assignee: The British Petroleum Company p.l.c., London, England

[21] Appl. No.: 925,539

[22] Filed: Aug. 5, 1992

[30] Foreign Application Priority Data

Aug. 8, 1991 [GB] United Kingdom ..... 9117071

[51] Int. Cl.[5] ..... C07C 7/00; C07C 41/00; C10G 57/00; B01D 3/34

[52] U.S. Cl. ..... 585/864; 208/95; 208/102; 203/63; 203/66; 568/579

[58] Field of Search ..... 585/864, 834; 208/95, 208/102; 203/63, 66; 568/579

[56] References Cited

U.S. PATENT DOCUMENTS 3,356,594 12/1967 Makin et al. .
3,655,520 4/1972 Harkins, Jr. ..... 585/637
4,409,421 10/1983 Herwig et al. ..... 585/833

FOREIGN PATENT DOCUMENTS 1079706 5/1950 France ..... 4/14

*Primary Examiner*—Anthony McFarlane
*Assistant Examiner*—Nhat D. Phan
*Attorney, Agent, or Firm*—Michael F. Esposito; David J. Untener

[57] ABSTRACT

The impurity content, e.g. propionitrile, in a fraction containing $C_5$ or $C_6$ tertiary olefins obtained by cracking hydrocarbons is reduced by distilling with an alkanol and removing the impurity as a higher boiling point fraction.

16 Claims, No Drawings

PROCESS FOR REMOVING IMPURITIES FROM PETROLEUM PRODUCTS

FIELD OF THE INVENTION

The present invention relates to improvements in removing impurities from hydrocarbons such as the hydrocarbons produced by the cracking of hydrocarbon feedstocks. In particular it is concerned with improvements in the preparation of feeds containing olefins for use in the preparation of ethers by reaction with alkanols.

BACKGROUND OF THE INVENTION

Hydrocarbon feeds derived from petroleum are commonly cracked to produce a product containing lower molecular weight hydrocarbons for use for various purposes. The cracked products generally contain olefins which are useful reactants for various purposes. Among olefins which may be present in cracked products are tertiary olefins, for example $C_4$ (iso-butene), $C_5$ and higher tertiary olefins. Iso-butene may be reacted with alkanols to give alkyl tertiary butyl ethers. Thus iso-butene may be reacted with methanol to give MTBE (methyl tertiary butyl ether). The $C_5$ and higher tertiary olefins may be reacted with alkanols to give alkyl tertiary alkyl ethers. Thus $C_5$ tertiary olefins may be reacted with methanol to give TAME (tertiary amyl methyl ether). These ethers are well-known to be useful as additives for gasoline.

Petroleum contains various sulphur and nitrogen compounds which can have an adverse affect on the activity of catalysts. In particular fractions obtained by cracking high boiling petroleum fractions can contain undesirable impurities. The etherification reactions mentioned above are generally carried out using acidic catalysts, for example acidic ion exchange resins. It has been found that basic nitrogen compounds present in cracked products used as feed to such etherification reactions can have an adverse effect on the activity of the acidic catalyst. Guard beds containing an acidic material, such as the acidic ion exchange resin, have been used to remove basic compounds before the olefin feed is reacted with the alkanol.

We have now found that despite the use of such guard beds the activity of catalysts used to react $C_5$ tertiary olefins with alkanols has declined due to the presence of one or more catalyst poisons which appear able to pass through the conventional guard beds. We have now found a new procedure for lowering the content of an undesirable impurity from fractions containing $C_5$ or $C_6$ hydrocarbons obtained by cracking materials derived from petroleum.

SUMMARY OF THE INVENTION

According to the present invention the process for reducing the content of an impurity in a fraction containing $C_5$ or $C_6$ tertiary olefins obtained by distillation of a cracked product obtained by the cracking of material derived from petroleum so as to recover a fraction containing $C_5$ or $C_6$ material as a distillate comprises feeding a lower alkanol to the distillation, and removing the impurity as a fraction with a higher boiling point than the fraction containing $C_5$ or $C_6$ olefins.

References to $C_5$ or $C_6$ tertiary olefins are to be understood as also including feeds containing both $C_5$ and $C_6$ tertiary olefins.

The impurity removed by the process of the present invention is a compound containing hetero atoms, i.e. atoms other than carbon and hydrogen, and in particular nitrogen-containing compounds. More than one impurity may be present and may be wholly or partially removed by the process of this invention. The process of the invention is particularly suitable for removing propionitrile, which we have found to be present in certain hydrocarbon streams resulting from the processing of petroleum.

Propionitrile can pass through guard beds which would remove basic materials. It has been found to have an adverse effect on the long term activity of certain catalysts. Propionitrile is a relatively high boiling material which on the basis of the boiling point of the pure material would not be expected to be found in the $C_5$ or $C_6$ overhead fraction.

The cracking step may conveniently be a catalytic cracking step, e.g. fluid catalytic cracking which may be applied to a gas oil fraction, or to feeds containing residues.

The process of the present invention can be usefully employed in removing impurities from streams containing $C_4$, $C_5$ and $C_6$ tertiary olefins as well as feeds containing $C_5$ and $C_6$ tertiary olefins, but no substantial quantities Of $C_4$ hydrocarbons. It can also be applied to streams containing $C_6$ tertiary olefins, but no substantial quantities of $C_5$ hydrocarbons. Alternatively, the process can be applied to streams containing $C_5$ tertiary olefins but no substantial quantities Of $C_6$ hydrocarbons.

The feed may contain only 1 or 2% weight Of $C_5$ or $C_6$ tertiary olefins, as in a gasoline range catalytically cracked spirit (CCS), but preferably contains at least 4% weight $C_5$ or $C_6$, or $C_5$ and $C_6$ tertiary olefins as in a typical light catalytically cracked spirit (LCCS) or the feed to a depentaniser column. The feed to the distillation with alkanol preferably contains hydrocarbons with boiling points above those of the $C_5$ or $C_6$ olefins recovered as a distillate, for example $C_7$ and higher hydrocarbons, as these may provide a higher boiling fraction into which an impurity can be concentrated, while allowing the alkanol to be recovered separately from the impurity in a lower boiling fraction.

The fraction containing $C_5$ or $C_6$ tertiary olefins taken overhead in the distillation step may contain higher olefins, for example $C_6$ or $C_7$ olefins, provided the feed to the distillation process and the distillation conditions are chosen so as to leave a higher boiling hydrocarbon fraction in which the undesirable impurity, e.g. propionitrile, is concentrated.

The alkanol may be a methanol, ethanol, or a mixture of the two.

Persons skilled in distillation will understand that the distillate fraction containing $C_5$ tertiary olefins may not necessarily contain all the $C_5$ olefins fed to the distillation step. Depending on the distillation conditions used minor amounts of the olefin may be left in a higher boiling fraction. The same will be true for a distillate fraction containing $C_6$ tertiary olefins.

The distillation may be carried out to produce an overhead stream containing $C_5$ tertiary olefins and a bottoms stream in which the impurity, e.g. propionitrile, is concentrated. Alternatively a $C_5$ hydrocarbon fraction containing tertiary olefins may be recovered as an overhead stream, a fraction enriched in impurity, e.g. propionitrile, may be recovered as a side stream, and higher boiling materials with a low impurity content recovered as a bottoms product.

The alkanol may be added to the main distillation step in which the fraction containing $C_5$ or $C_6$ tertiary olefins is separated from higher boiling material. Alternatively it may be preferred to subject a lower boiling fraction from the main distillation to a second distillation step to which alkanol is added to recover a bottoms fraction, and an overhead fraction containing the $C_5$ or $C_6$ tertiary olefins and the alkanol.

The quantity of alkanol fed is preferably adjusted so that substantially all the alkanol is recovered in the distillate fraction. The use of large amounts of alkanol relative to the quantity of $C_5$ hydrocarbons present may lead to significant quantities of alkanol appearing in the boiling fraction in which the impurities are concentrated. This will make recovery of the alkanol for further use more difficult. The mole ratio of alkanol to $C_5$ hydrocarbon may, for example, be in the range 1:0.5 to 1:12, preferably 1:1 to 1:8, more preferably 1:2 to 1:4. For methanol weight ratio which may be used are for example 1:3 to 1:15, preferably 1:5 to 1:10.

The molar ratio of alkanol to $C_6$ hydrocarbons is preferably in the range 1:0.2 to 1:6, preferably 1:0.5 to 1:4, more preferably 1:1 to 1:2.

Where a mixture of $C_5$ and $C_6$ hydrocarbons is used then the alkanol used to satisfy the mole ratio requirement for $C_5$ hydrocarbon is not counted for the purposes of satisfying the mole ratio requirement for $C_6$ hydrocarbon.

Thus the molar ratio of alkanol to $C_5$ and $C_6$ hydrocarbons is based on a combination of the two sets of ratios above. For example, for a 1:1 molar ratio of $C_5/C_6$ hydrocarbons may use a ratio of 1:0.3 to 1:9, preferably 1:0.8 to 1:6, more preferably 1:1.5 to 1:3.

The process of the present invention may be used to purify the feed to a process for the production of tertiary alkyl ethers by an etherification reaction in which a mixture of tertiary olefins having four and five carbon atoms in the molecule is reacted with methanol or ethanol over an acidic catalyst. Alternatively it can be used to purify a feed to a process for making tertiary alkyl ethers in which methanol or ethanol is reacted with feed containing tertiary olefins having not less than five carbon atoms in the molecule. Processes for the production of tertiary alkyl ethers are well-known and there is therefore no need to describe them in detail here. Because the alkanol used to remove the impurities, e.g. propionitrile, is a reactant in the etherification reaction there is no need to remove it from the feed stream containing the $C_5$ or $C_6$ olefins.

The process of the present invention is advantageous when combined with an etherification process in which the etherification step is carried out in the presence of hydrogen. Thus processes for the etherification reaction have been disclosed in which reactive dienes are hydrogenated and in which isomerisation of olefins occurs simultaneously with an etherification reaction (EP 0 338 309). Catalysts used for such reactions include cationic ion exchange resins in the hydrogen form which also contain hydrogenating metals. The process of the present invention is also beneficial when carried out with a feed containing $C_5$ or $C_6$ tertiary olefins before the tertiary olefins are fed to a process for making ethers by the catalytic distillation technique.

The invention will now be described with reference to the following Examples.

EXAMPLE 1

A mixture consisting of 132.5 g of a typical FCC (Fluid Catalytic Cracker) $C_5$ fraction obtained as overheads from a depentanizer column and 23.6 g of methanol was batched distilled using a method based on ASTM D2892-84. This method uses 15 theoretical plates and a reflux ratio of 5:1. The composition of this mixture is shown as Feed in Table 2. Once a steady state was established in the distillation, aliquots of distilled product were collected in approximately 20 milliliter amounts. The distilled product samples were collected in a consecutive manner until most of the feed had been distilled. Each fraction and the residue were examined for nitrogen content from which the propionitrile content was determined, and the major components were identified by gas chromatography. The boiling ranges of the fractions, the total weight of each fraction, and the propionitrile content are shown in Table 1. The composition of the fractions is shown in Table 2.

Table 1 shows that the propionitrile content of the fractions taken overhead is greatly reduced compared with the feed. Most of the propionitrile remains in the residue.

TABLE 1

| Fraction | Boiling Range °C. | Weight (g) | Propionitrile ppm wt/wt |
|---|---|---|---|
| Feed | | 156.1 | 51 |
| 1 | IBP-26.4 | 13.2 | 4.7 |
| 2 | 26.4-27.4 | 12.0 | 9.8 |
| 3 | 27.4-28.0 | 12.0 | 7.5 |
| 4 | 28.0-28.6 | 12.5 | 4.3 |
| 5 | 28.6-29.3 | 13.0 | 3.9 |
| 6 | 29.3-30.0 | 12.2 | 2.8 |
| 7 | 30.0-30.8 | 12.5 | 2.4 |
| 8 | 30.8-31.7 | 12.1 | 5.1 |
| 9 | 31.7-32.8 | 12.6 | 5.1 |
| 10 | 32.8-38.4 | 12.9 | 11.4 |
| Residue | | 26.1 | 271 |

IBP = initial boiling point

In Table 1 and subsequent tables a concentration of zero indicates that the compound could not be detected by the gas chromatography method used.

TABLE 2

| | % Composition by Weight | | | | | | | | | |
|---|---|---|---|---|---|---|---|---|---|---|
| Fraction | Me | 2MB1 | iP | PI | 2MB1 | nP | tP2 | cP2 | 2MB2 | others |
| Feed | 15.1 | 1.6 | 19.5 | 4.8 | 9.2 | 3.8 | 11.5 | 6.1 | 15.6 | 12.8 |
| 1 | 8.0 | 10.1 | 47.4 | 6.5 | 9.3 | 1.6 | 3.9 | 1.6 | 2.7 | 8.9 |
| 2 | 8.3 | 3.6 | 44.1 | 8.2 | 13.6 | 3.4 | 7.8 | 3.5 | 6.1 | 1.4 |
| 3 | 7.5 | 2.3 | 39.2 | 8.4 | 14.5 | 4.2 | 10.1 | 4.6 | 8.4 | 0.8 |
| 4 | 7.2 | 1.6 | 34.1 | 8.3 | 14.9 | 4.9 | 12.0 | 5.5 | 10.6 | 0.9 |
| 5 | 8.1 | 1.0 | 28.1 | 7.8 | 14.6 | 5.5 | 14.0 | 6.6 | 13.2 | 1.1 |
| 6 | 6.4 | 0.6 | 22.0 | 7.2 | 14.2 | 6.1 | 16.4 | 8.1 | 17.4 | 1.6 |
| 7 | 6.9 | 0.2 | 12.9 | 5.7 | 12.3 | 6.5 | 19.2 | 10.1 | 23.6 | 2.6 |
| 8 | 9.2 | 0.2 | 9.9 | 4.9 | 10.9 | 6.2 | 19.5 | 10.5 | 25.7 | 3.0 |
| 9 | 9.6 | 0.05 | 4.0 | 3.0 | 7.4 | 5.5 | 20.4 | 11.8 | 33.0 | 5.2 |
| 10 | 10.5 | 0.01 | 0.8 | 1.1 | 3.1 | 3.1 | 16.3 | 10.7 | 37.1 | 17.3 |

TABLE 2-continued

| Fraction | % Composition by Weight | | | | | | | | | |
|---|---|---|---|---|---|---|---|---|---|---|
| | Me | 2MB1 | iP | PI | 2MB1 | nP | tP2 | cP2 | 2MB2 | others |
| Residue | 48.7 | 0.0 | 0.04 | 0.05 | 0.2 | 0.2 | 1.4 | 1.0 | 4.7 | 43.7 |

A small amount of methanol separated out as a distinct phase in fractions 6 and 7. The values quoted for methanol content do not include this separated material. The amount of propionitrile includes the propionitrile in the methanol phase.

In Table 2 Me is methanol, 3MB1 is 3-methylbut-1-ene, iP is isopentane, P1 is pent-1-ene, 2MB1 is 2-methylbut-1-ene, nP is n-pentane, tP2 is trans-pent-2-ene, cP2 is cis-pent-2-ene, and 2MB2 is 2-methylbut-2-ene.

In this Example there a larger amount of methanol than that required to distill over the reactive $C_5$ olefins and some remains in the residue.

EXAMPLE 2

This Example shows the effect of adding $C_6$ hydrocarbons to the feed to the distillation, and the use of a smaller amount of methanol.

A mixture consisting of 116.0 g of a typical FCC $C_5$ composition obtained as overheads from a depentanizer column, 15.6 g of hexane, 15.6 g of hex-1-ene, and 8.8 g of methanol was batched distilled in a manner similar to Example 1. The composition of the mixture is shown as feed in Table 4, the boiling ranges, and the propionitrile content of the fractions are shown in Table 3.

TABLE 3

| Fraction | Boiling Range °C. | Weight (g) | Propionitrile ppm wt/wt |
|---|---|---|---|
| Feed | | 151.6 | 43.3 |
| 1 | IBP-25.8 | 12.6 | 5.2 |
| 2 | 25.8-27.1 | 12.6 | 1.5 |
| 3 | 27.1-27.9 | 11.9 | 2.1 |
| 4 | 27.9-28.5 | 12.6 | <0.8 |
| 5 | 28.5-29.4 | 12.0 | <0.8 |
| 6 | 29.4-30.1 | 11.9 | <0.8 |
| 7 | 30.1-31.0 | 12.0 | 5.5 |
| 8 | 31.0-37.1 | 12.1 | 165 |
| 9 | 37.1-57.1 | 13.0 | 247 |
| 10 | 57.1-63.5 | 12.9 | 50 |
| 11 | 63.5-65.3 | 12.5 | 16.5 |
| Residue | | 13.3 | 173 |

A mall amount of methanol separated out as a distinct phase in fractions 2 to 7. The values quoted for methanol content do not include this separated material. The values quoted for propionitrile include any in the methanol phase.

In Table 4 $C_4$s are $C_4$ hydrocarbons, Me is methanol, 3MB1 is 3-methylbut-1-ene, iP is isopentane, P1 is pent-1-ene, 2MB1 is 2-methylbut-1-ene, 2MB2 is 2-methylbut-2-ene, H is hexane, H1 is hex-1-ene, and ot is others. tr indicates that trace amounts were detected.

The propionitrile contents of the lower boiling fractions were significantly reduced. Large amounts of propionitrile appear in the distillate only when all the methanol has been distilled overhead, leaving none in the distillation flask to form azeotropes.

COMPARATIVE TEST A

An experiment was carried out as in Example 1, using 196.0 g of depentanizer column overheads, but without addition of methanol.

The results are shown in Tables 5 and 6. As can be seen from Table 5 the propionitrile predominantly appears in the low boiling fractions.

TABLE 5

| Fraction | Boiling Range °C. | Weight (g) | Propionitrile ppm wt/wt |
|---|---|---|---|
| Feed | | 195 | 53.8 |
| 1 | IBP-29.0 | 12.7 | 132 |
| 2 | 29.0-30.1 | 12.2 | 97.5 |
| 3 | 30.1-30.4 | 12.4 | 77.0 |
| 4 | 30.4-30.9 | 12.2 | 71.0 |
| 5 | 30.9-31.4 | 13.2 | 67.2 |
| 6 | 31.4-31.9 | 12.6 | 63.0 |
| 7 | 31.9-32.5 | 12.3 | 51.5 |
| 8 | 32.5-33.1 | 12.5 | 44.8 |
| 9 | 33.1-33.9 | 12.7 | 37.3 |
| 10 | 33.9-34.7 | 12.9 | 32.2 |
| Residue | | 61.6 | 31.4 |

TABLE 4

| Fraction | % Composition By Weight | | | | | | | | | | | | |
|---|---|---|---|---|---|---|---|---|---|---|---|---|---|
| | $C_4$s | Me | 3MB1 | iP | P1 | 2MB1 | P | tP2 | cP2 | 2MB2 | H | H1 | ot |
| Feed | 0.8 | 5.6 | 1.4 | 17.3 | 4.5 | 8.1 | 3.5 | 10.2 | 5.4 | 13.9 | 10.7 | 9.6 | 9.1 |
| 1 | 7.2 | 5.1 | 10.9 | 50.9 | 7.1 | 9.5 | 1.6 | 3.6 | 1.5 | 2.4 | 0 | 0 | 0.2 |
| 2 | 0.5 | 3.1 | 2.8 | 45.0 | 9.6 | 15.0 | 3.9 | 8.9 | 4.0 | 6.9 | 0 | 0 | 0.3 |
| 3 | 0.1 | 7.0 | 1.4 | 35.4 | 9.0 | 15.2 | 4.8 | 11.4 | 5.3 | 9.6 | 0 | 0 | 0.8 |
| 4 | 0 | 6.0 | 0.9 | 29.3 | 8.6 | 15.1 | 5.5 | 13.8 | 6.6 | 13.0 | 0 | 0 | 1.2 |
| 5 | 0 | 3.2 | 0.6 | 23.7 | 8.0 | 14.9 | 6.3 | 16.5 | 8.2 | 17.2 | 0 | 0 | 1.4 |
| 6 | 0 | 5.9 | 0.3 | 16.0 | 6.4 | 12.8 | 6.5 | 18.5 | 9.6 | 21.9 | tr | 0 | 2.1 |
| 7 | 0 | 9.2 | 0.1 | 9.5 | 4.7 | 10.1 | 6.1 | 19.5 | 10.6 | 26.8 | 0.1 | tr | 3.3 |
| 8 | 0 | 8.4 | tr | 4.4 | 2.9 | 6.9 | 5.3 | 19.8 | 11.7 | 33.9 | 0.3 | 0.1 | 6.3 |
| 9 | 0 | 0.7 | tr | 1.0 | 0.9 | 2.4 | 2.9 | 13.2 | 8.5 | 32.1 | 11.6 | 4.0 | 22.7 |
| 10 | 0 | 0.1 | 0.1 | 0.1 | 0.1 | 0.2 | 0.4 | 1.9 | 1.3 | 5.9 | 40.0 | 20.1 | 29.9 |
| 11 | 0 | tr | tr | tr | tr | tr | 0.2 | 0.1 | 0.1 | 0.5 | 43.3 | 33.6 | 24.0 |
| Residue | 0 | 0 | 0 | 0 | 0 | 0 | tr | tr | tr | tr | 28.4 | 54.9 | 16.7 |

TABLE 6

| Fraction | % Composition By Weight | | | | | | | | | |
|---|---|---|---|---|---|---|---|---|---|---|
| | $C_4$ | 3MB1 | iP | PI | 2MB1 | nP | tP2 | cP2 | 2MB2 | others |
| Feed | 1.2 | 1.9 | 23.0 | 5.7 | 10.9 | 4.5 | 13.5 | 7.2 | 18.3 | 13.8 |

TABLE 6-continued

| | % Composition By Weight | | | | | | | | | |
|---|---|---|---|---|---|---|---|---|---|---|
| Fraction | $C_4$ | 3MB1 | iP | PI | 2MB1 | nP | tP2 | cP2 | 2MB2 | others |
| 1 | 11.7 | 13.4 | 46.0 | 7.2 | 10.7 | 1.5 | 4.3 | 1.9 | 3.0 | 0.3 |
| 2 | 0.6 | 4.5 | 46.8 | 9.3 | 15.4 | 3.1 | 8.7 | 4.0 | 7.0 | 0.6 |
| 3 | 0.1 | 3.1 | 43.3 | 9.3 | 15.4 | 3.7 | 10.3 | 4.8 | 8.8 | 0.7 |
| 4 | tr | 2.5 | 40.6 | 9.1 | 16.0 | 4.1 | 11.4 | 5.4 | 10.1 | 0.8 |
| 5 | tr | 1.9 | 36.9 | 8.8 | 16.0 | 4.6 | 12.8 | 6.1 | 11.9 | 1.0 |
| 6 | 0 | 1.4 | 33.7 | 8.4 | 15.6 | 5.0 | 13.9 | 6.8 | 13.5 | 1.7 |
| 7 | 0 | 1.0 | 29.3 | 8.0 | 15.2 | 5.5 | 15.4 | 7.7 | 16.0 | 1.9 |
| 8 | 0 | 0.7 | 25.5 | 7.5 | 14.7 | 6.0 | 17.1 | 8.5 | 18.4 | 1.6 |
| 9 | 0 | 0.4 | 20.4 | 6.7 | 13.6 | 6.4 | 18.7 | 9.7 | 22.0 | 1.3 |
| 10 | 0 | 0.2 | 14.8 | 5.5 | 11.8 | 6.8 | 20.4 | 11.0 | 26.6 | 2.9 |
| Residue | 0 | tr | 2.9 | 1.5 | 3.7 | 3.9 | 13.7 | 8.3 | 27.2 | 38.8 |

COMPARATIVE TEST B

A continuous distillation process was carried out using a conventional distillation column fed with a light catalytically cracked spirit (LCCS) containing 36.0% wt $C_5$ hydrocarbons.

The feed contained 10 ppm of propionitrile. It was introduced at about half way up the column. The base of the column was at 110° C. and the head of the column at 66° C. The feed was introduced at the rate of 3.72 volumes per hour at a temperature of 63° C., 1.52 volumes per hour were taken off at the head (overheads), 2.20 volumes per hour were taken off at the base (bottoms), and the reflux rate was 3.04 volumes per hour. The head of the column was at a pressure of 2 bar (0.2 MPa), and the pressure drop between base and the top of the column was 0.049 mbar.

The overheads were found to contain about 6.7% wt of $C_4$ hydrocarbons and 9.6% wt of $C_6$ hydrocarbons with the balance being various $C_5$ hydrocarbons. The overheads contained 14 ppm of propionitrile.

The bottoms contained no $C_4$ and $C_5$ hydrocarbons, and 45.3% of $C_6$ hydrocarbons. The rest was material having more than 6 carbon atom in the molecule. No propionitrile was detected.

EXAMPLE 3

An experiment was carried with the apparatus used in Comparative Test B except that a side stream was withdrawn from the column in addition to the overhead and bottoms stream. The side stream was taken off at about three quarters of the height of the column.

Methanol was added with the feed to the distillation column at the rate of 0.19 volumes per hour. The LCCS feed was introduced to the column at the rate of 3.72 volumes per hour as in Comparative Test B. The overheads were taken off at the rate of 1.37 volumes per hour, the bottoms were taken off at the rate of 2.27 volumes per hour, and the side stream was taken off at the rate of 0.30 volumes per hour. The base of the column was at a temperature not significantly different from that in Comparative Test B. The temperature at the head of the column dropped to 54° C. The side stream was taken from the column at 65° C.

The overheads contained 6.6% wt of total $C_4$ hydrocarbons, 11.7% wt methanol, and 0.8% wt of total $C_6$ hydrocarbons. The balance was $C_5$ hydrocarbons, including 7.2% wt of 2-methylbut-1-ene, 13.6% wt of 2-methylbut-2-ene and 1.1% wt of 3-methylbut-1-ene. Propionitrile was not detected.

The bottoms contained no $C_4$ or $C_5$ hydrocarbons, and contained 48.0% wt of $C_6$ hydrocarbons. The rest was material having more than 6 carbon atoms in the molecule. No propionitrile were detected.

The side stream contained less than 1% wt of $C_4$ hydrocarbons, 19.8% wt of methanol, and 44.7% wt of $C_6$ hydrocarbons, and the rest were $C_5$ hydrocarbons. Among $C_5$ hydrocarbons present were small quantities of branched olefins, namely 2.7% wt of 2-methylbut-1-ene, 8.0% wt of 2-methylbut-2-ene, and 0.2% wt of 3-methylbut-1-ene. The content of propionitrile was 100 ppm.

EXAMPLE 4

An experiment was carried out using the apparatus of Comparative Test B. Methanol was added to the feed as in Example 3 but no side stream was taken off.

The LCCS feed was introduced at the rate of 3.72 volumes per hour, together with 0.19 volumes of methanol per hour. The overheads were taken off at the rate of 1.71 volumes per hour, and the bottoms were taken off at the rate of 2.20 volumes per hour.

The overheads contained 4.0% wt of total $C_4$ hydrocarbons, 7.1% wt of $C_6$ hydrocarbons, and 13.4% wt of methanol. The remainder was $C_5$ hydrocarbons including 6.7% wt of 2-methylbut-l-ene, 13.1% wt of 2-methylbut-2-ene and 1.0% of 3-methylbut-i-ene. No propionitrile was detected.

The bottoms product contained no $C_4$ or $C_5$ hydrocarbons and 52.7% wt of $C_6$ hydrocarbons, and 0.2% wt of methanol. Propionitrile was detected at a level of 10 ppm by weight.

EXAMPLE 5

An experiment was carried out as in Example 4 (i.e. with no side stream taken off) but using an increased feed rate of methanol.

The LCCS feed was introduced at the rate of 3.72 volumes per hour together with 0.21 volumes per hour of methanol. Overheads were removed at the rate of 1.71 volumes per hour, and the bottoms were removed at the rate of 2.23 volumes per hour.

The overheads contained 5.0% wt of $C_4$ hydrocarbons, 5.6% wt of $C_6$ hydrocarbons and 13.2% wt of methanol. The remainder of the overheads were $C_5$ hydrocarbons, including 6.8% wt of 2-methylbut-1-ene, 13.1% wt of 2-methylbut-2-ene and 1.0% wt of 3-methylbut-1-ene. Propionitrile was not detected.

The bottoms contained no $C_4$ or $C_5$ hydrocarbons, 50.7% wt of $C_6$ hydrocarbons, and 3.1% wt of methanol. Propionitrile was detected at a level of 10 ppm.

EXAMPLE 6

An experiment was carried out as in Example 5. The rate at which feed was introduced and product was removed was similar to those in Example 5, but methanol was fed at a higher rate, namely 0.23 volumes per hour.

The overheads contained 4.3% wt of $C_4$ hydrocarbons, 10.5% wt of $C_6$ hydrocarbons, and 13.9% wt of methanol. The remainder consisted of $C_5$ hydrocarbons, including 6.2% wt of 2-methylbut-1-ene, 12.9% wt of 2-methylbut-2-ene and 0.8% wt of 3-methylbut-1-ene. No propionitrile were detected.

The bottoms contained no $C_4$ or $C_5$ hydrocarbons, 51.1% wt of $C_6$ hydrocarbons, and 1.5% wt of methanol. Propionitrile was present at a 10 ppm level.

EXAMPLE 7

An LCCS, boiling range 33° to 109.5° C. was shown by fluorescent indicator adsorption (FIA) to contain 3.9% by volume of aromatics, 42.9% by volume of olefins, and 53.2% by volume of saturates, and by gas chromatography to contain ca 30% by weight of $C_5$ hydrocarbons and ca 30% by weight of $C_6$ hydrocarbons. To 201 g of this LCCS was added 0.010 grams of propionitrile and 24.0 grams of methanol to give a mixture containing at least 11.3 ppm wt/wt of nitrogen as propionitrile. As can be seen from the nitrogen analysis of this mixture, 14.7 ppm wt/wt, further amounts of nitrogen-containing components were present in the LCCS. This mixture was batched distilled using a method based on ASTM D2892-84. Once dissolved $C_4$s (4.0 g) had been removed and a steady state was established in the distillation, aliquots of distilled product were collected in approximately 17 to 18 milliliters amounts. Each fraction was examined for nitrogen content and the major components were identified by gas chromatography. The boiling range of each fraction, the nitrogen content, and the major component types are shown in Table 7.

This example shows that both $C_5$ and $C_6$ streams can be co-distilled with methanol from a mixture containing $C_5$ and $C_6$ streams in the presence of sufficient methanol to ensure azeotrope formation between $C_5$ and $C_6$ components and methanol, and only co-distil minor amounts of the propionitrile contained in the distillation mixture. Co-distillation of the bulk of the propionitrile occurred only when methanol had been distilled out of the distillation flask.

TABLE 7

| Fraction | Boiling Range °C. | Weight g | Nitrogen ppm wt/wt | Approx. Composition of Hydrocarbon Components* $C_5$s % wt | $C_6$s % wt | Others % wt |
|---|---|---|---|---|---|---|
| Feed | 33–109.5 | 225 | 14.7 | 30 | 30 | 40 |
| 1 | 15–28.7 | 30.8 | 9.4 | 99 | 1 | |
| 2 | 28.7–39.8 | 29.3 | 6.6 | 85 | 15 | |
| 3 | 39.8–46.4 | 30.5 | 3.5 | 24 | 76 | |
| 4 | 46.4–48.9 | 31.6 | 2.6 | 3 | 95 | 2 |
| 5 | 48.9–50.3 | 16.1 | 7.6 | | 90 | 10 |
| 6 | 50.3–80.0 | 15.8 | 155 | | 56 | 44 |
| Residue | >80 | 66.9 | 6.1 | | 1 | 99** |

*Disregarding methanol in the fraction.
**Only trace of methanol observed in this sample.

I claim:

1. A process for reducing the content of an impurity in a fraction containing $C_5$ or $C_6$ tertiary olefins obtained by distillation of a cracked product, said process comprising the steps of feeding an alkanol selected from the group consisting of ethanol, methanol, and mixtures thereof to the distillation of the cracked product and recovering the impurity as a fraction with a higher boiling point than the fraction containing the $C_5$ or $C_6$ tertiary olefins.

2. The process according to claim 1 wherein the impurity comprises a nitrogen-containing compound.

3. The process according to claim 2 wherein the nitrogen-containing compound is propionitrile.

4. The process according to claim 1 in which the cracked product is produced by fluid catalytic cracking.

5. The process according to claim 2 in which the cracked product contains a substantial amount of $C_5$ or $C_6$ hydrocarbons.

6. The process according to claim 5 wherein the cracked product contains hydrocarbons with more than five or six carbon atoms.

7. The process according to claim 2 wherein the cracked product is substantially free of $C_4$ hydrocarbons.

8. The process according to claim 1 wherein the alkanol is methanol or ethanol.

9. The process according to claim 1 which comprises subjecting the cracked product to a first distillation to recover $C_5$ or $C_6$ material as a first distillate, subjecting the first distillate to a second distillation, feeding the alkanol to the second distillation, recovering a fraction containing the $C_5$ or $C_6$ material as a second distillate, and recovering the impurity during the second distillation as a fraction with a higher boiling point than the fraction containing the $C_5$ or $C_6$ tertiary olefins.

10. The process according to claim 1 wherein the quantity of alkanol fed to the distillation of the cracked product is adjusted so that substantially all of the alkanol is recovered as a distillate fraction.

11. The process according to claim 3 wherein the molar ratio of alkanol to any $C_5$ hydrocarbon is in the range 1:0.5 to 1:12 and the molar ratio of alkanol to any $C_6$ hydrocarbon is 1:0.2 to 1.6.

12. The process according to claim 11 wherein the molar ratio of alkanol to $C_5$ hydrocarbon is in the range 1:2 to 1:4 and the molar ratio of alkanol to any $C_6$ hydrocarbon is in the range 1:1 to 1:2.

13. The process according to claim 1 wherein the distillation of the cracked product is carried out to any give a fraction containing $C_5$ or $C_6$ tertiary olefins as an overhead fraction, a side stream enriched in impurity, and a bottoms fraction with a relatively low impurity content.

14. The process according to claim 1 wherein the fraction containing $C_5$ or $C_6$ tertiary olefins contains $C_5$ tertiary olefins.

15. The process according to claim 1 wherein the fraction containing $C_5$ or $C_6$ tertiary olefins is fed to an etherification reaction in which it is reacted with methanol or ethanol over an acidic catalyst.

16. The process according to claim 15 wherein the etherification reaction is carried out in the presence of hydrogen.

* * * * *